United States Patent [19]

D'Agnolo

[11] 4,320,563

[45] Mar. 23, 1982

[54] DEVICE FOR CONTINUOUSLY RELAXING YARNS

[75] Inventor: Armando D'Agnolo, Pordenone, Italy

[73] Assignee: Officine Savio S.p.A., Pordenone, Italy

[21] Appl. No.: 14,830

[22] Filed: Feb. 26, 1979

[30] Foreign Application Priority Data

Feb. 24, 1978 [IT] Italy ..... 83334 A/78

[51] Int. Cl.[3] ..... D02G 1/20

[52] U.S. Cl. ..... 28/248; 28/281

[58] Field of Search ..... 28/281, 289, 248; 242/47, 13; 68/5 D

[56] References Cited

U.S. PATENT DOCUMENTS

| | | | |
|---|---|---|---|
| 2,268,866 | 1/1942 | Furness | 242/47.13 |
| 3,131,729 | 5/1964 | Leysinger | 242/47.13 X |
| 3,426,553 | 2/1969 | Erb | 28/281 X |
| 3,683,650 | 8/1972 | Hirschburger | 28/281 X |

FOREIGN PATENT DOCUMENTS

| | | | |
|---|---|---|---|
| 2055463 | 5/1972 | Fed. Rep. of Germany | 242/47.13 |
| 2411644 | 9/1975 | Fed. Rep. of Germany | 28/281 |

OTHER PUBLICATIONS

*New Continuous Yarn Shrinking and High-Bulking Machine.* Meilliand Textilberichte. p. 675, Aug., 1979.

*Primary Examiner*—Robert Mackey

*Attorney, Agent, or Firm*—Stevens, Davis, Miller & Mosher

[57] ABSTRACT

Device for the continuous relaxing of synthetic yarn, comprising a rotatable distributor carrying in a coordinated manner in torsional equilibrium and activated lengthwise several closed rotating rings, a relaxing oven having an outlet, the relaxing oven enclosing at least part of the rotating distributor, a fan at the outlet of the oven to invest the yarn by a current of air, fixed guides to guide coils of yarn on at least an initial tract of the closed rings, electrical resistance elements to heat gaseous fluid, a fan to force circulation of the gaseous fluid in said relaxing oven, a rack and pinion to adjust the vertical distance between centers of the closed rings, fixed guides to deform partially the coils unwinding and photoelectric cells to control the position of the reserve of yarn.

12 Claims, 7 Drawing Figures

DEVICE FOR CONTINUOUSLY RELAXING YARNS

This invention relates to a device for suitably bringing about continuous relaxing and relative thermosetting at the degree of relaxing desired for synthetic yarns for industrial purposes. The synthetic yarns may be high-bulk acrylic yarns or else two-component synthetic yarns, such as polyamides and polyesters.

Relaxing devices are already known; in particular ovens of a straight form are known wherein the yarn receives the desired quality of heat.

This operation to heat the yarn is directily linked to the speed at which the yarn is processed, and therefore to make relaxing devices for high-speed machines it is necessary to increase the length of such devices considerably with the consequent drawback that the devices become bulky.

Bulky devices are also known wherein there is a rotating distributor of yarn that cooperates with at least four rings of belts onto which the rotating distributor deposits the coils of yarn, part of the lengthwise extent of the rings of belts being affected by a relaxing oven.

This device is very bulky and involves heavy dispersion of energy without controlled thermosetting.

The present invention has as an object to provide a device suitable for creating the relaxing desired together with the relative thermosetting of synthetic yarns.

Another object of this invention is to provide a device suitable for installation on winding machines without any modification of the overall vertical, horizontal or depth-wise dimensions thereof.

Another object of this invention is not to modify the working frontage for the machine operator nor to change the typical sizes suitable for working purposes.

A still further object is to provide a device able to obtain high rates of production, as are necessary for modern industrial requirements, namely rates of more than a thousand meters a minute.

Yet another object is to provide a device able to start with a bobbin or another package and to redeliver the treated yarn continuously and directly to a bobbin.

According to the invention the yarn is brought to a pneumatically activated conveyor, which feeds it to a rotating distributor positioned within a relaxing oven.

The rotating distributor delivers the yarn in coils to a closed-ring conveyor stretching lengthwise, which adapts its own crosswise section independently of the requirements of the relaxing of the coils and thereby controls continuously and independently the size of the coils to suit the ideal degree of relaxing thereof.

The coils are caused to pass through the oven, wherein a gaseous fluid is kept under forced circulation at the desired temperature.

The coils move from the oven into a cooling zone, beyond which they are unwound and the yarn, which has by now been relaxed and thermoset, is wound up by a spooler.

Differing degrees of advantages are provided by having the rotating distributor positioned inside the relaxing oven.

The most important advantage is derived from the ability to reduce the length of the device considerably.

The second most important advantage lies in the fact that the system becomes easier to insulate and contains only very small spaces from which dispersion of heat can occur.

The third most important advantage consists in the shock of relaxation which the yarn undergoes as soon as it leaves the rotating distributor and which this invention employs to restrict the overall dimensions of the device. This automatically leads to still further reduction in the length of the oven inasmuch as there is enough, in the oven remaining, to relax the yarn further to very low percentage values so as to reach the required degree of relaxing. The yarn should never be relaxed to the limit of its capability owing to subseqyent processing operations. According to the invention the oven is kept at a temperature to suit the gaseous fluid employed and when said gaseous fluid is air, should be kept at between 140° and 190° C. It has been found that advantageous results are obtained at temperatures of about 160° to 170° C. The coils leaving the rotating distributor tend to relax at once, as said earlier, and are controlled dimensionally and at the same time guided and moved forwards by the action of a series of chutes coordinated with the closed rotating rings of the conveyor means. The closed-ring conveyors are formed in such a way as to control the regular relaxing of the coils in their first tract so that said coils undergo a linear desired and controlled relaxing. The reason for this is that the coils are always stressed with a coordinated and desired action of resistance to the relaxing taking place, the action of resistance meanwhile preventing the formation of curls.

Moreover the invention arranges not only to regulate the speed of removal of the relaxed yarn but also to regulate the winding speed and, therefore, the speed of lengthwise forward movement of the closed rings of the conveyor, the two parameters being linked to each other.

The invention also envisages regulating the speed of the internal means circulating the gaseous fluid, the purpose of this being to regulate the number of exchanges per hour of said fluid in the relaxing chamber. The fluid is partly exchanged for gaseous fluid arriving from outside, and the number of exchanges per hour is generated by the circulation means conditioning the constant temperature of the fluid itself within the staytime and space of the relaxing chamber.

According to the invention the gaseous fluid in the relaxing chamber undergoes partial exchange owing to the movement of the coils and to the dispersion taking place through the space for departure from the lengthwise conveyor oven.

The fluid in the relaxing chamber may consist of, or be mainly, of air and is kept advantageously at the desired temperature by electrical resistances so as to ensure that the temperature is kept as constant as possible. With this kind of heating means the response times are shorter than with other kinds. However, this does not prevent the use of other types where required.

According to the invention the gaseous fluid is sucked from the lower part of the relaxing chamber by a circulating means, which then reintroduces it from above.

This plan for the path of the gaseous fluid has been provided because before reaching the circulating means, the gaseous fluid passes between finned or corrugated surfaces able to transmit their heat to it without retaining the dust, fibers or any enzymic oils released by the yarn while it is being relaxed.

At the outlet of the circulating means the gaseous fluid is sent into narrow ducts, where it reaches a high speed that accentuates heat exchange between the finned or corrugated parts and the gaseous fluid passing therebetween. These finned or corrugated parts are kept heated by said electrical resistances.

The combination of said fins and the position of the electrical resistances meets the requirements for cleaning necessitated by the oven since the dust does not settle but is carried into circulation and falls onto the coils, being removed therewith.

At the exit from the oven there is advantageously envisaged at least one outlet with a slight aspiration depression so as to suck out and remove the fumes and smells emitted by the yarn during its treatment. The purpose of this is to prevent the machine operator from breathing these fluids in their gaseous state, which damage the human body.

When the coils leave the oven, they are caused to pass through a strong currnet of air which has two specific purposes.

The first and main purpose is to cool the yarn so that it will be wound up when it is no longer in a thermoplastic state, when mechanical stresses could still be set in it.

The second purpose is to shake and clean the coils from the dust deposited on them in the oven.

At the outlet of the flow of cooling air the invention envisages advantageously a system for controlling the reserve of yarn.

This control system causes the coils not to move too far forward towards the end of the closed rings of the conveyor and also not to remain too far back thereon. The control system causes the coils not to be wound off too quickly.

In fact if the coils move forward too far, the unwinding becomes difficult; whereas if they remain too far back, the tension in the yarn being unwound increases. Moreover where the coils remain too far back, they may be brought to a postion where they can no longer be physically unwound.

Such a control system can consist advantageously of two pairs of photoelectric cells or of any other known system which can be used for this purpose.

The activation of such photoelectric cells can increase or decrease the speed of winding or unwinding of the uarn by means of connections of a known type.

During the approach to the area of unwinding of the yarn the invention envisages positioning means that cooperate with the closed rings of the lengthwise conveyor.

The reciprocal positions of the positioning means and the rings, so far as possible, reconvert the coils from a square section to a round section.

At least the upper closed rings in the upper tract are advantageously supported by guides to prevent them from yielding because their own catenary is added to the catenary generated by the coils and from running the risk of the coils being stacked on each other.

There are advantageously at least four closed rings in the lengthwise conveyor, two being upper and the other two lower rings.

The closed rings may consist of rounded belts or flat or square belts, etc. Hereinafter they will be described indifferently as rounded belts or closed rings so as to facilitate the description, but such terms shall comprise any desired variant.

The closed rings advantageously have fixed reciprocal positions at their starting end (near the rotating distributor), while their reciprocal positions in the departure zone can advantageously be adjusted.

The terminal adjustment of the closed rings enables a desired reciprocal conicity to be imparted to them. This adjustment can affect one axis only or else both axes of the plane lying at right angles to the lengthwise extension of the rings.

The invention therefore consists of a continuous relaxing device for synthetic yarn which may be but is not limited to being of an acrylic type. The device is formed of a rotating distributor, which sustains in a coordinated manner in torsional equilibrium and activates lengthwise a plurality of closed rotating rings, and of a relaxing oven. The device is characterized by the facts that the relaxing oven encloses at least partially the rotating distributor and the closed rings are invested at the outlet of the oven by a flow of air, whereby there are fixed means to guide the coils which are forming and said fixed means cooperate with at least an initial tract of the closed rings, and whereby there are means to heat gaseous fluid, means to provide forced circulation of the gaseous fluid in the relaxing oven, means to adjust the reciprocal lengthwise positions of the closed rings, fixed means to cause partial deformation of the coils unwinding and means to control the position of the reserve of yarn, at least part of the physical and mechanical parameters of the device being adjustable.

The present invention will be described in more detail with respect to the embodiments shown in the accompanying drawings given by way of non-limiting example, in which equal or equivalent parts are marked by the same reference numerls and in which.

Figure 1:
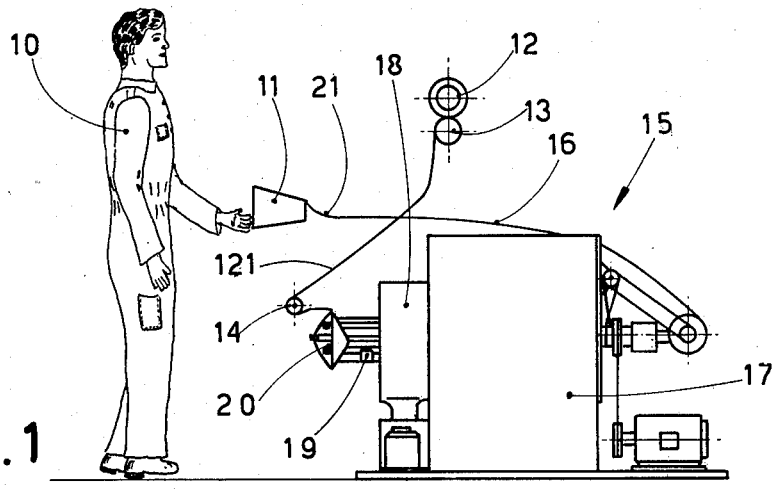
FIG. 1 is a diagrammatic side view of the present invention.

Referring now to the drawings operator 10 stands at the front of the winding machine and has the various parts of the winding machine and of the device 15 of the invention accessible to him in a manner suitable for his work. Package 11 is the yarn to be relaxed which is wound up on the bobbin 12 after being relaxed. Cylinder 13 distributes the yarn on the bobbin 12. Overfeed roller 14 serves to remove tension from the yarn being wound up. Pneumatic conveyor 16 enables the operator 10 to send the end of the yarn 21 into inlet 22 through pipe 116 to be relaxed to inside the device 15 without leaving the front of his machine. The relaxing oven is generically designated as 17 while 18 is generically the cooling group. Group 19 controls the reserve of coils and serves to control the positioning of the unwinding of the coils. The relaxed yarn 121 departs through device 20. Nozzle 23 serves to blow into the pipe 116 the gaseous fluid suitable for conveying the yarn 21 introduced by the operator 10 into the inlet 22. The gaseous fluid may be blown only when the yarn is introduced or be blown continuously and may have additions of possible treatment substances or perhaps be kept at a desired temperature. Motor 24 activates the rotating distributor and is advantageously of a type of which the speed can be varied as required. Pulley 25 takes its motion from the motor 24 and transmits it to the rotating distributor, to which it is integrally fixed. Belt 26 takes the rotary motion of the rotating distributor and transmits it to a transmission pulley 27, which in its turn activates the pulley 28 connected to the feeder or drawing roller 29. Drawing roller 29 has the task of overfeeding the yarn. In fact, as soon as the yarn 21 passes inside the pipe 116, the yarn 21 is put under tension by the rotating distributor and comes out through a slot, not shown, in the pipe 116 in the tract where the pipe enfolds the roller 29; the yarn then comes into contact with the periphery of the roller itself, which assists its forward movement. Pipe 30 feeds the compressed gaseous fluid that serves to enable the yarn to be introduced into the rotating distributor. The fluid introduced into 30 can have the same characteristics as those of the fluid introduced into 23. Transmission belt 31 takes its motion direct from the cylinder 13 and transmits it to the pulley 32 of the feeder roller 14. Motor 33 rotates cylinder 13 and is of a known and adjustable type. Motor 34, preferably of a variable-speed type, activates the fan 43 of the cooling group 18. The lengthwise lower closed rings or rounded belts are designated as 35. Means 37 enlarge or deform the coils unwinding and cooperate with the rounded belts 35 and 36 in the end tract of the device. The deforming means tend to restore to an almost circular shape the coils during the unwinding phase of the latter since, if this is done, the unwinding is more even and gentle. Aperture 38 sucks the fumes outwards. Suction pipe 39 cooperates with the aperture 38. Suction manifold 40 cooperates with the pipe 39. Organ 41 creates the desired depression in the manifold 40. The cooling group 18 carries deflecting fins 42. Motor 44, being preferably of a variable-speed type, activates the circulating fan 45 located in the oven 17. Insulating material 46 provides heat insulation for the chamber. The rotating distributor has in inlet 47, venturi means 48 through which the compressed air or fluid flowing from 30 creates the desired depression in 47 and a duct 49. A toothed wheel 50 is machined on the body of the rotating distributor. Toothed wheel 51 receives its motion from the toothed wheel 50 and transmits it to the worm screw 52, which sets in motion the toothed wheel 53, which in its turn is connected rigidly to the pulley 56 towing the closed rounded belts, there being one towing pulley for each belt 35 and 36. A rack and pinion group 57, 58 adjust the vertical distance between centers of the transmission pulleys 156. In the example shown, the horizontal distance between centers may be fixed or be capable of being pre-set. Labyrinth means 59 limit the escape of hot fluid. Labyrinth means 59 are circular baffles with annular cavities into which the gas penetrates creating thus a back pressure at the annular area which impedes the exit of gases from the oven chamber 60. Chamber 60 of the oven encloses at least a part of the rotating distributor. Fins 61 and 161 transmit heat to the gaseous fluid circulating. Chamber 62 is positioned below the circulation fan 45. Lateral ducts 63 put back into circulation the fluid removed by the fan 45. Deflectors 64 distribute the fluid reintroduced into the chamber 60. Inspection ports 65 and 165 are located in any easily accessible position. Heating resistances 66 are shown in the example as being buried in the metallic mass. A mass 67 stabilises the group bearing the closed towing rings and serves to keep in balance the whole group of the closed towing rings. Guides 68 position and sustain the rounded belts 35 or 36. Photoelectric cell 69 controlls the maximum permitted backward position of the coils unwinding. Photoelectric cell 70 controlls the maximum forward position of the coils unwinding.

Figure 5:
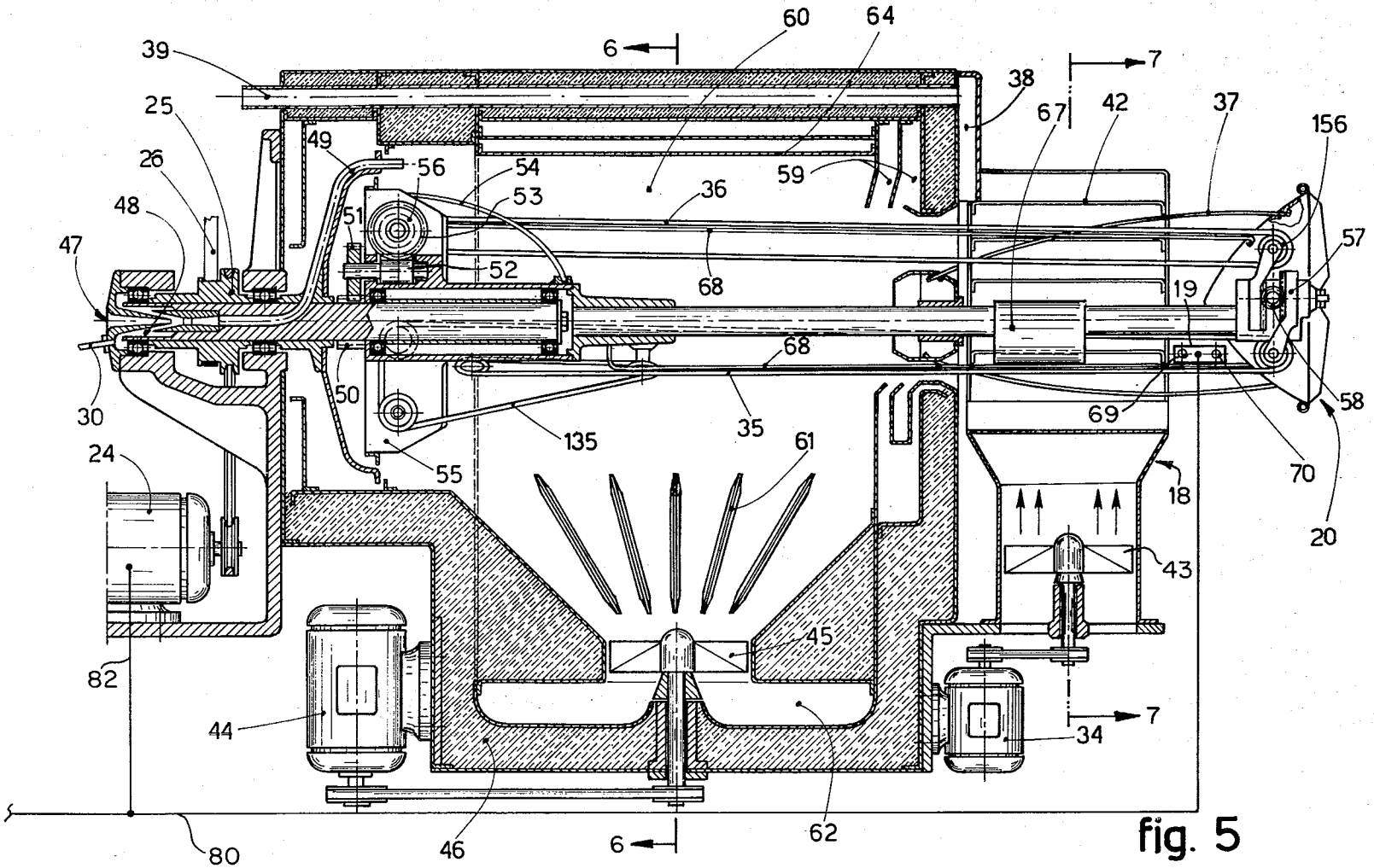
FIG. 5 is a vertical side section view of the invention.
Figure 7:
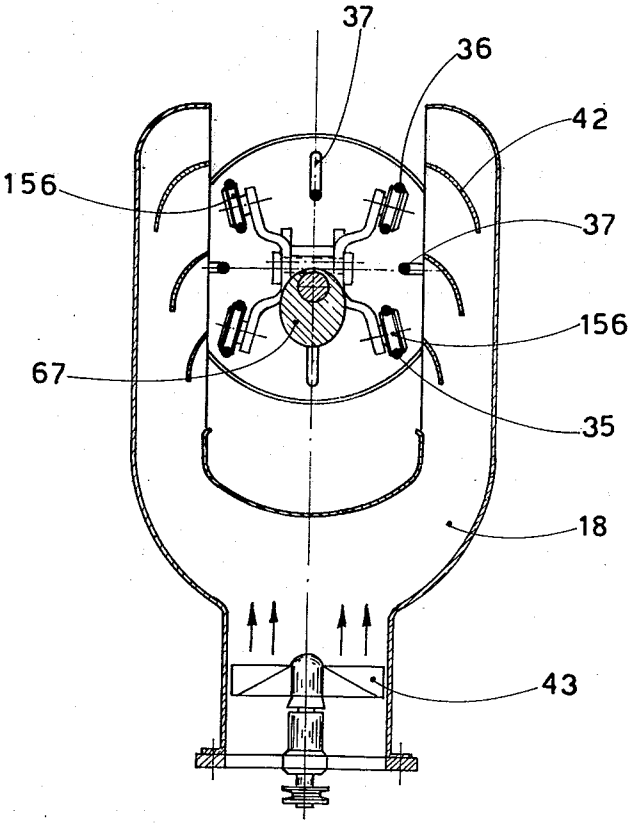
FIG. 7 is a section along line 7—7 of FIG. 5.
Figure 6:
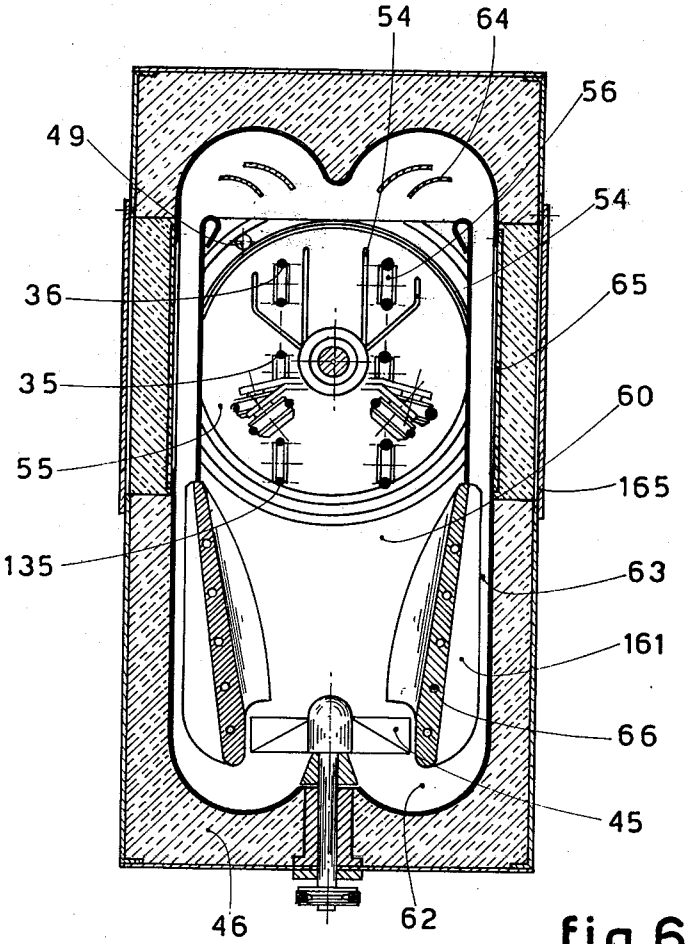
FIG. 6 is a section along line 6—6 of FIG. 5.

As can be seen in FIG. 5, the rotating distributor lays the coils on the body 55 from which the fixed guides 54 jut out. The fixed guides 54 cooperate with the rounded belts 36 so that the coils slide along the fixed guides 54 and are pulled forwards in a coordinated manner by the rounded belts themselves.

The rounded belts 35 can include in their first tract a transmission means, so that the coils will come to a heavily sloped tract 135.

The shape of the guides 54, the presence of the rounded belts 36 and the form of the belts 35 at 135 have the effect that the coils, which in the first tract could be relaxed by a very high value, are actually conditioned with a gradual, controlled relaxing, which prevents anomalies, heaps, curls, etc.

The stabiliser mass 67 serves to prevent the group bearing the closed towing rings from rotating around its axis as a consequence of the action of the rotating distributor.

The guides 68 serve to prevent the rounded belts from increasing their natural catenary owing to the gripping action of the coils relaxing. Depending on the type of yarn and type of gaseous fluid employed, the parameters are determined for the temperature of the circulating fluid, the speed of distribution of the coils of yarn to be relaxed and the speed of collection of the yarn when relaxed.

The device is operated by inserting the yarn into the inlet 22 and at the same time activating the jet of gaseous fluid through the pipe 23.

The gaseous fluid carries the yarn 21 inside the pipe 116 and brings it in front of the inlet 47.

The activation of gaseous fluid through 23 takes place at the same time as the activation of gaseous fluid through the pipe 30.

The fluid leaving 30 activates the venturi means 48, so that a depression is formed in 47 and cooperates with the action of the gaseous fluid coming from 23 to carry the yarn inside the pipe 49 of the rotating distributor.

The yarn 21 arriving from the pipe 49 coils itself in spirals on the body 55, whence the coils move forward regularly in the chamber 60 owing to the coordinated action of the rounded belts 35, 36 and 135 together with the effect of the guides 54.

From the chamber 60 the coils pass through the current of air generated by the fan 43 and are cooled and cleaned at the same time.

In fact, the fan 45 sucks down the gaseous fluid in the chamber 60 and reintroduces it into circulation from above, the result being that any loose fibers, oil, dust and so on are deposited on the upper side of the coils and are not withheld on any other part.

When the first coils reach the photoelectric cell 70, a memory-type control system of a known kind, which is not shown here, halts the rotating distributor and thus also stops the advance of the closed rings 35 and 36.

This step is advantageously necessary to enable the machine operator to take the end of the yarn 121 already relaxed and to prearrange it, according to requirements, on the winding machine.

As soon as the yarn 121 has been positioned, the distributor (and therefore the advance of the rounded belts also) is started up again, and the winding machine is set in motion.

The collection speed is kept at a lower value than the winding speed, said lower value corresponding to the average value of relaxing.

If for any reason the coils unwinding should be positioned backwards towards the oven to such an extent as to be beyond the photoelectric cell 69, the rotation of the rotating distributor is speeded up. The opposite takes place if the coils unwinding are forward beyond the photoelectric cell 70.

The conditionings carried out by the photoelectric cells on the motor organs are realized with control circuits which are of a known type and are not shown here.

Figure 2:
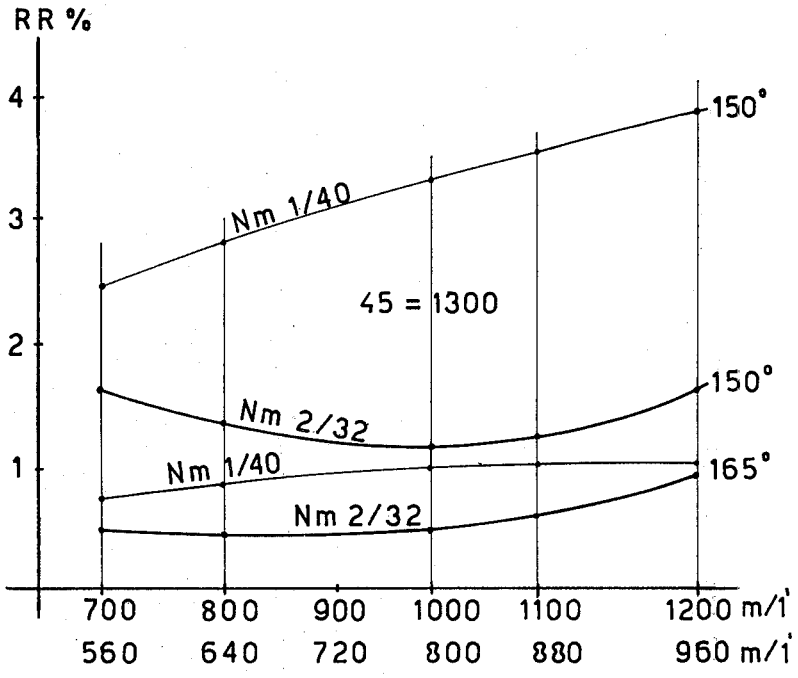
FIG. 2 is a graph of the results of a relaxing experiment utilizing the device of the invention.
Figure 4:
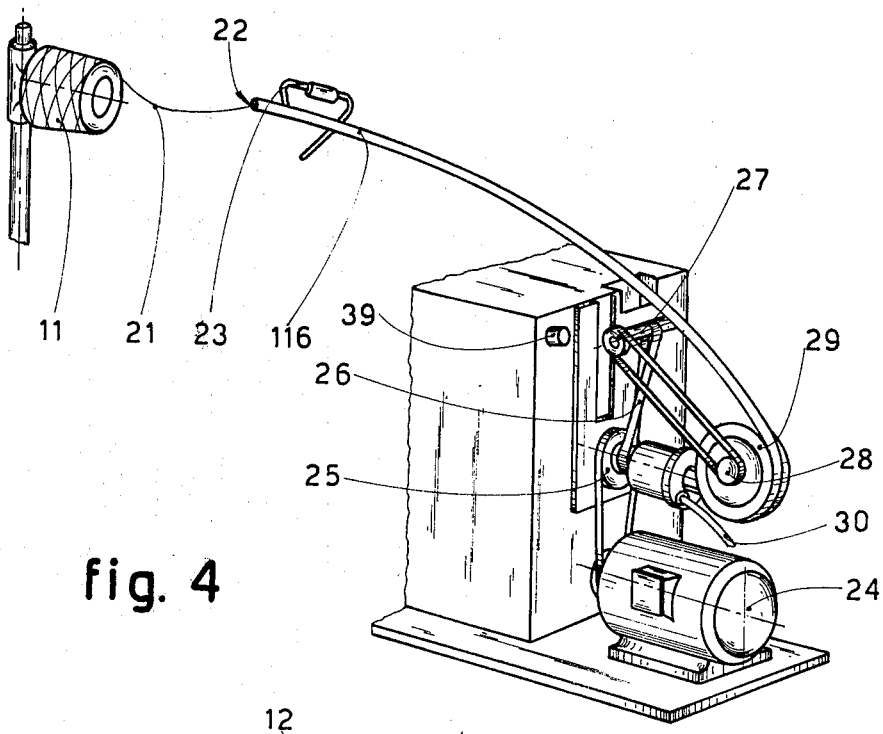
FIG. 4 is a three-quarters back view of the invention.
Figure 3:
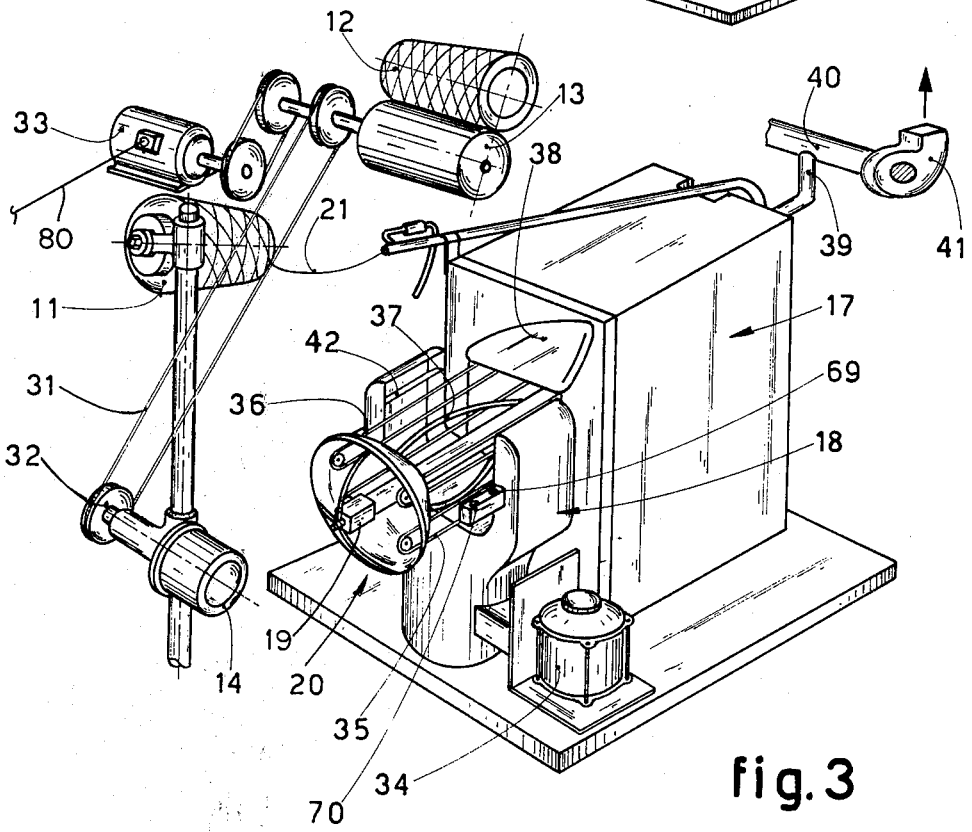
FIG. 3 is a three-quarters front view of the invention.

In FIG. 2 an example is given of the behavior of two types of yarn at two different treatment temperatures and with different parameters of mechanical adjustment.

In the example given the tests were conducted with a fan 45 having a diameter of about 140 mm. and kept rotating at about 1300 revolutions per minute; the useful horizontal section of the relaxing chamber 60 used in this test was about 350 mm. long by 200 mm. wide.

As can be seen in the graph, a variation in the mechanical parameters caused a small variation in the relaxing residue, whereas the contrary was the case with a small temperature variation (−15° C.). In fact there were considerable variations in the relaxing residue in the latter case. The residue is the difference between the nominal or required shrinkage necessary for the relaxation of the yarn and the actual shrinkage achieveable in practice. In the test conducted, the yarns with Nm 2/32 had a relaxing residue on an average more than doubled, while the yarns with Nm 1/4 had a residue on an average more than trebled.

The yarn numbers (Nm 2/32 and 1/40) are the standard methods of designating the yarn type according to the International Standard or metric system, whereby the numerator indicates the yarn count and the denominator indicates the number of filaments coupled together to form the yarn. The yarn count itself is defined as the length in meters divided by the weight in grams.

A preferential solution has been described. Variants are possible and are contained within the scope of the invention.

I claim:

1. Device for the continuous relaxing of synthetic yarn, comprising a rotatable distributor carrying in a coordinated manner in torsional equilibrium and activated lengthwise several horizontal closed rotating rings, said rotatable distributor applying coils of yarn about said closed rotating rings to form a yarn reserve thereon, a relaxing oven having an outlet, said relaxing oven enclosing at least part of the rotating distributor, air movement means at the outlet of the oven to invest the coils of yarn by a current of air, fixed means to guide coils of yarn on at least an initial tract of the closed rings, means to heat gaseous fluid, means to force circulation of the gaseous fluid in said relaxing oven, means to adjust the vertical distance between the closed rings, fixed means to deform partially the coils of yarn cooperating with the closed rotating rings and adjacent an end tract thereof, means to control the position of the reserve of yarn adjacent said end tract and means for unwinding yarn from the closed rotating rings.

2. The device of claim 1 including a pneumatic conveyor positioned before the entry inlet of the rotating distributor, an inlet of the pneumatic conveyor delivering the yarn being positioned on the same side as the departure outlet for the closed rotating rings from the oven, pneumatic means to introduce yarn into said rotating distributor and overfeed means which receive yarn from said pneumatic conveyor and deliver it to said rotating distributor.

3. The device of claim 1 wherein the air movement includes at least one fan and at least one duct for conveying air which has been stirred by said fan.

4. The device of claim 1 wherein the fixed means to deform the yarn coils include stationary means to modify the cross section of the yarn coils.

5. The device of claim 1 wherein the means controlling the position of the reserve of yarn include means to control the forward position of the yarn coils and said means to control the forward position of the yarn coils adjusting the speed of formation of the yarn coils.

6. The device of claim 1 wherein the means controlling the position of the reserve of yarn include means to correlate the speed of rotation of the rotating distributor to the unwinding speed and adjust the speed of rotation of the rotating distributor.

7. The device of claim 1 wherein said means for unwinding the yarn from the closed rotating rings comprises a winding machine, said relaxing device and winding machine being arranged so that an working face tended by an operator is the same for the winding machine and for the relaxing device, said relaxing device being positioned below the winding machine.

8. The device of claim 1 wherein the means to force circulation of the gaseous fluid is a fan positioned in the lower part of the oven, and the means to heat said gaseous fluid are fins carrying electrical resistance elements, said elements located at least in one wall of said fins and invested on two sides by gaseous circulating ducts.

9. The device of claim 1 wherein the relaxing oven enfolds the rotating distributor and starts substantially near a rotating outlet of the distributor, the yarn coils being conveyed in a first tract by coordinated cooperation of said fixed guide means with the closed rotating rings, said closed rotating rings having a crosswise section for winding yarn coils which decreases rapidly in a lengthwise direction in the first tract.

10. The device of claims 9 or 8 including an aperture to remove fumes and baffle means to prevent heat dispersion positioned adjacent an exit end of the oven.

11. The device of claim 9 wherein the decreasing cross section is obtained by at least one closed ring having an intermediate return and said ring having a heavily sloped initial tract.

12. The device of claim 9 wherein the decreasing cross section is obtained by at least one supplementary closed ring heavily sloped in the lengthwise direction as compared to the other closed rings and positioned in the first tract.

* * * * *